United States Patent [19]

Schlosser

[11] Patent Number: 4,633,056

[45] Date of Patent: Dec. 30, 1986

[54] METHOD FOR MANUFACTURING SPECIAL-SECTION TUBES FOR TUBULAR HEAT EXCHANGERS AND TUBES PROVIDED BY SUCH METHOD

[75] Inventor: Werner Schlosser, Munich, Fed. Rep. of Germany

[73] Assignee: MTU Muenchen GmbH, Munich, Fed. Rep. of Germany

[21] Appl. No.: 612,555

[22] Filed: May 21, 1984

[30] Foreign Application Priority Data

Jun. 14, 1983 [DE] Fed. Rep. of Germany ..... 3321392
Jun. 20, 1983 [DE] Fed. Rep. of Germany ..... 3322130
Jul. 30, 1983 [DE] Fed. Rep. of Germany ..... 3327660

[51] Int. Cl.[4] ..... B23K 15/00
[52] U.S. Cl. ..... 219/121 ED; 219/137 R

[58] Field of Search ..... 219/121 LC, 121 LD, 219/121 EC, 121 ED, 59.1, 137 R; 138/115, 191

[56] References Cited

U.S. PATENT DOCUMENTS 2,655,181 10/1953 Cooper ..... 138/115
3,949,186 4/1976 Nakayama et al. ..... 219/121 ED

*Primary Examiner*—M. H. Paschall
*Attorney, Agent, or Firm*—Barnes & Thornburg

[57] ABSTRACT

A method for manufacturing special-section tubes having an oval cross section and a cross web for tubular heat exchangers by gradually profiling a metal strip and then joining the rims together substantially in the longitudinal direction of the tube.

8 Claims, 3 Drawing Figures

METHOD FOR MANUFACTURING SPECIAL-SECTION TUBES FOR TUBULAR HEAT EXCHANGERS AND TUBES PROVIDED BY SUCH METHOD

This invention relates to a method for manufacturing special-section tubes having an oval cross section and a cross web for tubular heat exchangers and to the tubes obtained with such method.

The manufacture of such special-section tubes is difficult above all on account of their very small size, where the major diameter of the oval contour runs in the range from 4 to 10 mm. and the minor diameter from 2 to 5 mm. The wall thicknesses are in the 1/10 mm. range, and the material must be high-grade to give the required degree of resistance to corrosion.

Heretofore, the practice has been to manufacture such special-section tubes by drawing from round tubular stock, whereby two tubes of equal cross section—each resembling an isosceles triangle with a straight base and bent legs—were drawn from round tubes and were subsequently joined together along their base. This method of manufacture, however, proved to be complicated and expensive. Its main disadvantage resides in particular in that it permits only the manufacture of limited tube lengths—which with the above-mentioned dimensions of the oval section would be somewhere around 2 m—and in that, in turn, a considerable waste results, when cutting to length, in the further processing of the tubes. Another disadvantage is that in the drawing operation, the wall thickness of the tubes can be maintained only within rather liberal tolerances, because the drawing core cannot safely be maintained in its central position. Finally, the semifinished product (the drawn tube stock) is expensive and the tool wear is considerable.

Accordingly, it is the object of the present invention to provide a method for manufacturing special-section tubes of the aforementioned type which ensure great dimensional accuracy of the special-section tubes produced and is less costly than the known method.

The underlying problems are solved by the present invention in that an endless metal strip is gradually contoured or profiled into the intended tubular shape and is then closed by joining together the edges in the longitudinal direction of the tubes.

The method of the present invention offers the advantage of great economy and accuracy of the special-section tubes produced. The economy of the method of this invention lies in the fact that it permits the production of infinite lengths, that a stock (endless metal strip) is used which is relatively low-priced, and that tool wear is practically eliminated. The dimensional accuracy achieved is largely attributable to the fact that the starting thickness of the wall remains unchanged and that, compared with the drawing operation, a material deformation is used which is far less damaging and much more gentle. Further advantages of the method of the present invention reside in that a better surface finish of the special-section tubes is attainable and that contamination of the material by drawing grease, as well as the need for subsequent cleaning, is eliminated. The method of the present invention, finally, is also adaptable in that it permits the manufacture of tubes of different wall thicknesses without tool change.

The method of the present invention finds especially advantageous application for tubes of modest profile cross sections and very small wall thickness. The special-section tubes for tubular heat exchangers manufactured by the method of the present invention are to have a maximum wall thickness of 0.3 mm.

In a preferred aspect of the present invention the metal strip used as stock is to have a constant thickness. This will enable the price of the stock to be held especially low.

Materials particularly suited for the semi-finished product (stock) are preferably nickel-base alloys, such as Hastelloy ® X.

In a specially advantageous aspect of the present invention, a right-angle Z-contour with long free legs is first formed from the straight metal strip, after which one or both ends of the free legs are given a right-angle joining bend, whereupon both free Z-legs are bent so far about a halfway point along the length of leg through more than 90° that the joining bend abuts on the Z-web. Furthermore, it is advantageous if the entire shaping is done on a single pass through a roller profiling machine. The joining bends are joined to the Z-web in the longitudinal direction of the tube by brazing or bonding, or if the load on the special-section tubes is very high, for example, during the further processing or also in service, the joint is preferably achieved by welding, and more particularly by electron beam welding.

Finally, another advantage is realized if the joining operation, more particularly the electron beam welding operation, is integrated into the roller profiling machine so that the manufacture will be continuous and without interruptions from the metal strip used as a starting material to the finished welded special-section tubes.

The present invention also relates to a special-section tube manufactured in accordance with a method of the present invention, and is characterized by the free end of the joining bend projecting into the cavity formed by the spear-shaped profile. The joining bend end projecting into the cavity can attribute to improved heat exchange between the medium flowing through the special section tube and the wall of the tube. Nonetheless, practically no higher manufacturing expenditure for a special-section tube constructed in this manner will result from the use of the method in accordance with the present invention.

According to a further feature of the present invention, a special-section tube as described hereinabove can be further developed in that the free end of the joining bend projecting into the cavity is moderately undulated. As a result thereof, an increased turbulence of the flow through the special-section tube can be attained and, thus, also the heat exchange between the flow medium and the special-section tube can be improved.

These and other objects of the method of the present invention and of the special-section tubes manufactured in accordance therewith will become more apparent from the following description when taken in conjunction with the accompanying drawing which shows, for purposes of illustration only, two embodiments in accordance with the present invention, and wherein.

Figure 1:
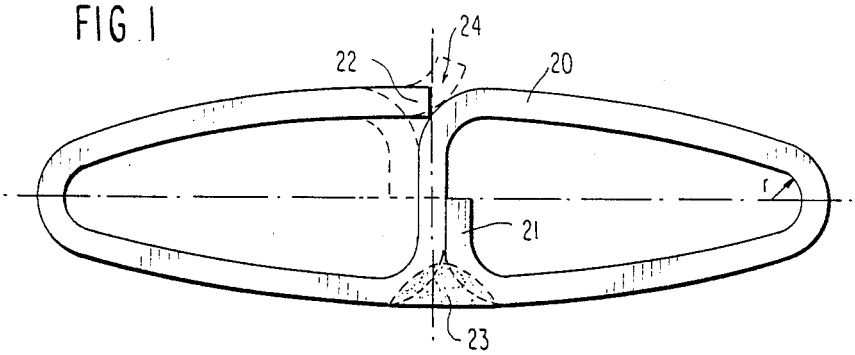
FIG. 1 is a cross-sectional view of a special-section tube manufactured in accordance with the method of the present invention, on a scale 50/1.

In the enlarged cross-sectional view of a special section tube in FIG. 1 the wall of the tube is designated by the reference numeral 20.

As will become apparent from FIG. 1, the cross section takes the contour of a slender oval or spear-shaped section. The small inner radius of the oval section is indicated by the letter "r". The outer wall of the special-section tube, as well as its web, are formed by bending a single-piece metal strip, whose one rim forms a joining bend 21 and whose other rim 22 terminates in a straight edge. In lieu of the straight-line edge 22, an outwardly or inwardly bent joining bend could also be used at this rim, as indicated by the dashed-line contour. The inwardly bent joining bend 21 is joined to the cross web of the tube by a weld 23. The straight rim 22 is joined at the point indicated by the arrowhead 24 to the cross web or to the transitional area between the cross web and the outer wall of the tube, again by welding. The alternatively outwardly or inwardly bent rims would be joined similarly to the cross web of the special-section tube by welding.

Figure 2:
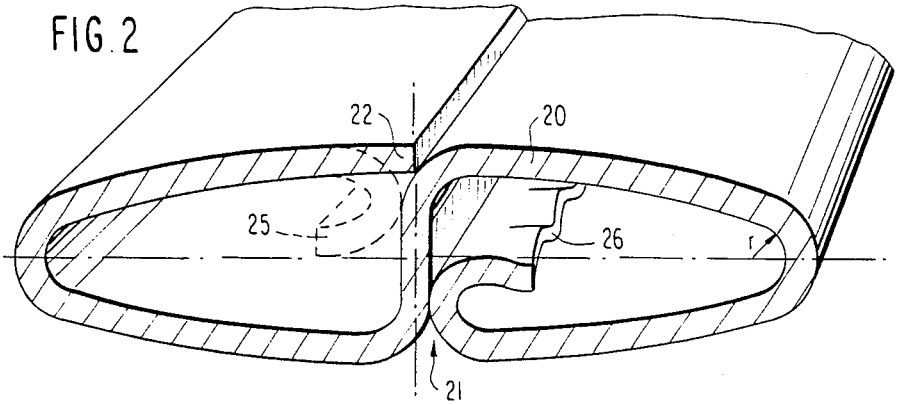
FIG. 2 is an oblique cross-sectional view of a further embodiment of a special-section tube in accordance with the present invention, again on a scale 50/1.

The embodiment of FIG. 2 differs from that of FIG. 1 in that two further options for the construction of the joining bend are shown. In lieu of the solid-line rim 22, use can be made of the dashed-line inwardly bent joining bend, the end 25 of which projects into the cavity formed by the spear-shaped section. The projecting material web in the cavity serves to augment the heat transfer. The end 25 of the joining bend thereby extends into the cavity in the form of a straight web. In an alternative embodiment, the construction shown in the right-hand cavity of the spear-shaped tube can be selected, where the end 26 of a joining bend 21 projecting into the cavity is moderately undulated. The undulated form serves to produce a turbulence (eddies or whirls) in the flow through the spear-shaped tube. In FIG. 2, the illustration of joined or welded connections at the ends of the joining bends was omitted. The welds or joints are here achieved similarly as shown in FIG. 1.

Figure 3:
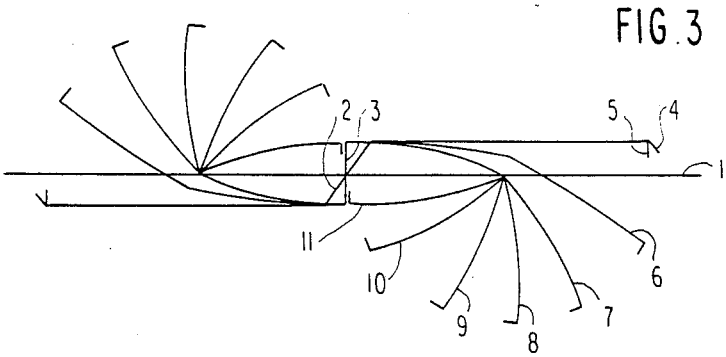
FIG. 3 is a schematic view illustrating a sequence of shaping steps leading from the metal strip to the finished profile of the tube in the method of the present invention.

In the sequence of profiling steps shown in FIG. 3, the wall is represented by a simple line for clarity of illustration. Starting with a straight metal strip 1 of constant wall thickness, the profiling steps 2 to 11 are performed to obtain the contour of the special-section tube. This will be followed by a joining or welding operation in two places, as mentioned in connection with FIG. 1.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A method for manufacturing special-section tubes having an oval cross section and a cross web for tubular heat exchangers, comprising the steps of gradually profiling an endless metal strip to shape the same into the intended tube section, wherein, starting with a flat planar metal strip, a substantially rectangular Z-contour is first shaped with long free legs joined by a short Z-web, thereafter at least one end of the free legs is given an approximately 180° joining bend near the free end wherein the distance between the free end and the long leg, after bending, is less than the length of the Z-web, and, whereupon both free Z-legs are then bent about a point approximately midway along the legs through approximately 180° so that the first joining bend will abut an outward portion of the Z-web and wherein the bent free end extends substantially parallel to and spaced from the long free leg at its juncture to the Z-web.

2. A method for manufacturing special-section tubes having an oval cross section and a cross web for tubular heat exchangers, comprising the steps of gradually profiling an endless metal strip to shape the same into the intended tube section, wherein, starting with a flat metal strip, a substantially rectangular Z-contour is first shaped with long free legs joined by a short Z-web, thereafter one end of the free legs is given an approximately right-angle joining bend outwardly of the Z-web, whereupon both free Z-legs are bent inwardly about a point approximately midway along the legs through approximately 180° so that the first bend joint will abut an outward portion of the Z-web with the end portion extending away from the Z-web.

3. A method according to claim 1, wherein the entire shaping operation is achieved in a single pass through a roller profiling machine.

4. A method according to claim 1, wherein the first bend portion of the long free leg is attached to the Z-web at the abutting location by electron beam welding.

5. A method according to claim 1, wherein one of the ends of the long free legs has its end surface formed with undulations which run parallel to the length of the long leg prior to the first bending operation.

6. A method according to claim 5, wherein the entire shaping operation is achieved in a single pass through a roller profiling machine.

7. A method according to claim 6, wherein the thickness of the metal strip is less than 0.3 mm.

8. A method according to claim 3 wherein one of said free end joining bends extends outwardly from the Z-web.

* * * * *